United States Patent [19]

Ball

[11] Patent Number: 4,785,977

[45] Date of Patent: Nov. 22, 1988

[54] AERATED LIQUID STORAGE/DISPENSING APPARATUS

[75] Inventor: Martin F. Ball, Wantage, Great Britain

[73] Assignee: Metal Box Public Ltd. Co., Berkshire, England

[21] Appl. No.: 908,992

[22] Filed: Sep. 18, 1986

[30] Foreign Application Priority Data

Sep. 24, 1985 [GB] United Kingdom ..... 8523575

[51] Int. Cl.[4] ..... B65D 83/00

[52] U.S. Cl. ..... 222/399; 222/400.7; 222/402.13; 222/402.14; 137/212; 137/505.13

[58] Field of Search ..... 222/399, 400.7, 402.13, 222/402.14, 394; 137/505.13, 505.25, 212, 588

[56] References Cited

U.S. PATENT DOCUMENTS

| | | | |
|---|---|---|---|
| 973,609 | 10/1910 | Abrams | 137/505.25 |
| 1,072,239 | 9/1913 | Kleinfeldt | 222/399 |
| 2,571,433 | 10/1951 | Fine et al. | 222/400.7 X |
| 3,186,599 | 6/1965 | Levinson et al. | 222/399 X |
| 3,240,403 | 3/1966 | Modderno | 222/399 |
| 3,259,194 | 7/1966 | McCrossan | 222/394 X |
| 3,327,899 | 6/1967 | Reynolds | 222/399 X |
| 3,613,954 | 10/1971 | Bayne | 222/61 |
| 3,756,472 | 9/1973 | Vos | 222/402.14 X |
| 3,930,519 | 1/1976 | Byrd | 137/505.25 |

FOREIGN PATENT DOCUMENTS

| | | | |
|---|---|---|---|
| 645987 | 5/1937 | Fed. Rep. of Germany | 222/399 |
| 938528 | 10/1963 | United Kingdom . | |
| 1013287 | 12/1965 | United Kingdom . | |
| 1135971 | 12/1968 | United Kingdom . | |
| 1177288 | 1/1970 | United Kingdom . | |
| 1196965 | 7/1970 | United Kingdom . | |
| 1236645 | 6/1971 | United Kingdom . | |
| 1293195 | 10/1972 | United Kingdom . | |
| 1504986 | 3/1978 | United Kingdom . | |

*Primary Examiner*—Joseph J. Rolla
*Assistant Examiner*—Gregory L. Huson
*Attorney, Agent, or Firm*—Wolf, Greenfield & Sacks

[57] ABSTRACT

An apparatus for storing and dispensing a quantity of aerated liquid for maintaining the carbonation of a beverage in a container. The apparatus includes a vessel containing a source of gas, a valve closing the vessel and a pressure regulator that couples the valve to the vessel. The pressure regulator is capable of delivering the gas to the container at a substantially constant pressure substantially lower than the pressure under which the gas is kept in the vessel. A tap permits delivery of the gas to, and dispensing of the liquid from, the container.

8 Claims, 2 Drawing Sheets

AERATED LIQUID STORAGE/DISPENSING APPARATUS

This invention relates to apparatus for storing and dispensing a quantity of aerated liquid. The apparatus is especially intended, though not exclusively suitable, for the storage and dispensing of so-called "carbonated beverages". By the term "carbonated beverages" is meant beverages which are colloquially usually referred to as "fizzy drinks", viz. lemonade, beers and other beverages which are made "fizzy" by the introduction of a gas. The gas most frequently used for this purpose is carbon dioxide. Likewise the term "aerated liquid" as used herein connotes a liquid which has been made "fizzy" by the introduction of any such gas as aforesaid.

The present invention may, for example, find application where, in order to avoid deterioration during storage owing to its chemical reaction with its environmental atmosphere, a liquid must be maintained in contact with a particular gas under a predetermined substantially constant pressure. However, the main field of application of the invention is presently thought to be that of such carbonated beverages as aforesaid; for convenience therefore, but without prejudice to the generality of the scope of the invention as hereinbefore stated and as hereinafter defined in the claims, the invention will hereinafter be discussed and exemplified in the context of such beverages.

Apparatus presently available for storing and dispensing a carbonated beverage includes the well-known beer can tap, which has a regulator but which uses a low volume/high-pressure source in the form of high-pressure bulbs containing carbon dioxide (at a pressure of about 7 MPa) which have no valve—only a bursting disc—and where once use has started there is no way to shut off the gas supply.

There has also previously been proposed a liquid or powder spray, the subject of British Pat. No. 922 347. The complete specification of that patent discloses such a sprayer having separate containers for a product and a propellant joined so that pressure on a joint handle releases the propellant into the product container and then the exit valve opens and the product can discharge. The disclosure includes a mechanical coupling of the delivery valve to a gas supply valve, but does not propose any automatic pressure regulating means.

It is an object of the present invention to provide apparatus which, unlike the prior art apparatus hereinbefore outlined, enables the storage and dispensing of an aerated liquid product over a period of time, e.g. fizzy drinks glass by glass, without deterioration of the product, viz. without progressive loss of "fizz" or "sparkle".

For this purpose, in accordance with the present invention, apparatus for storing and dispensing a quantity of aerated liquid in which the extent of aeration is maintained as said quantity is progressively dispensed, comprises a low-pressure source of gas in the form of a vessel; a valve closing said vessel; a container for said liquid, said container being connected to said vessel via a plastics pressure regulator, which is capable of delivering said gas to said container at a pressure substantially lower than said pressure under which said gas is kept in said vessel; and flow control means which permit delivery of said gas to, and dispensing of said liquid from, said container.

One form of apparatus embodying the invention, viz. a said apparatus for maintaining the carbonation of a beverage in a container, will now be described, by way of example, with reference to the accompanying diagrammatic drawings, in which:-

Figure 1:
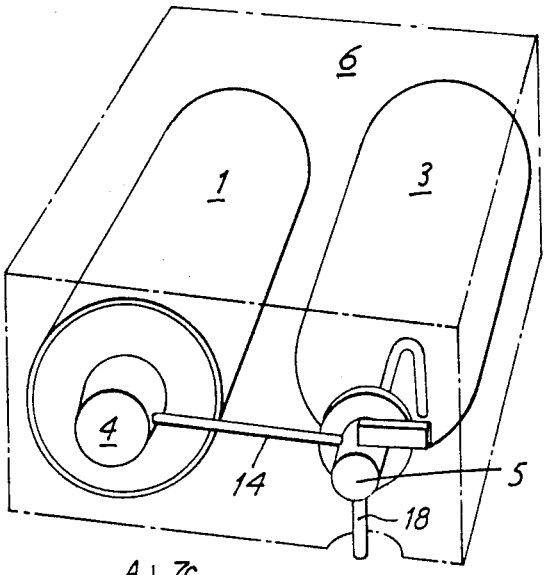
FIG. 1 is a perspective general assembly drawing of the apparatus.
Figure 2:
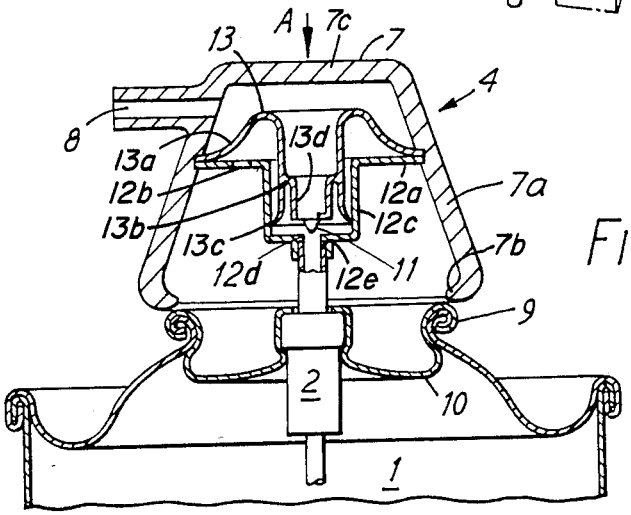
FIGS. 2 and 3 are sectional elevations of the regulator showing the latter respectively when the apparatus is in transit and when it is in use.
Figure 3:
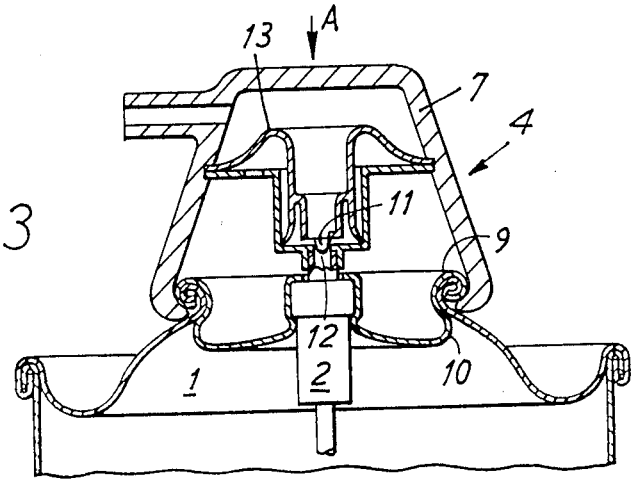

Referring now to FIGS. 1 to 3, the apparatus comprises a high volume/low pressure source of gas, e.g a vessel in the form of an aerosol can 1 containing carbon dioxide under pressure; a standard aerosol can valve 2; a container in the form of a bottle 3 which is made e.g. of polyethyleneterephthalate (PET) and contains the liquid to be aerated (viz. the beverage to be carbonated) and which is connected to the can 1 via the valve 2, a conduit 14 and a pressure regulator 4, which is capable of delivering the carbon dioxide to the bottle 3 at a reduced pressure (about 0.1 MPa) substantially lower than the source pressure (about 1 MPa) under which the carbon dioxide is kept in the can 1; and flow control means in the form of a 3-way tap 5, which permits delivery of the carbon dioxide to, and dispensing of the carbonated beverage from, the bottle 3, as hereinbefore described.

The aforesaid integers 1–5 are packed into an enclosure in the form of a cardboard outer box 6.

The regulator 4 comprises a housing 7 defining a "button" which, when depressed in the direction of the arrow A, converts the apparatus from an "in transit" to an "in use" condition.

The housing 7 has a skirt portion *7a* and an outlet 8 for the carbon dioxide from the can 1 into the bottle 3. In the "in transit" condition (FIG. 2) the housing 7 sits on a curl 9 on a cup 10 in which the valve 2 is mounted.

The regulator 4 further comprises a needle valve 11 which cooperates with a valve seat 12, and a resilient diaphragm 13; the latter is so dimensioned that the required pressure acting on its downstream area overcomes its initial set away from the valve seat, thus closing off the gas supply. Gas is then supplied to said container at a substantially constant pressure.

In this connection note in FIGS. 2 and 3 the vent hole **12*b*** that permits the diaphragm to flex under the influence of downstream pressure. The diaphragm construction is such that the ratio of the area downstream thereof to the area upstream thereof is such that the gas is caused to be delivered to the container at a substantially constant pressure.

Figure 4:
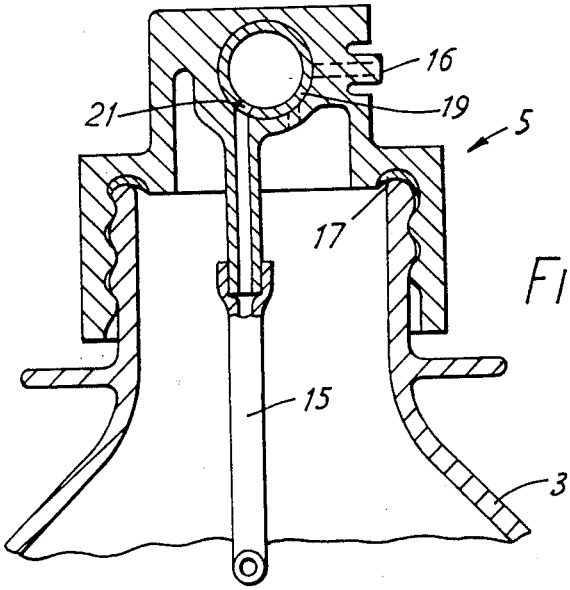
FIG. 4 is a sectional elevation of the flow control means, in the form of a 3-way tap.

Referring now to FIG. 4, the 3-way tap 5 shown is screwed on to the neck of the bottle 3 by rotation about the latter's longitudinal axis along which a dip tube 15 extends into the bottle 3.

The tap 5 has an inlet 16 for the carbon dioxide and a gasket 17 of flowed-in lining compound seals the tap 5 to the bottle 3. The conduit 14 (FIG. 1) interconnects the outlet 8 of the regulator 4 with the inlet of the tap 5.

In its three angular positions with respect to the bottle 3, the tap 5 respectively (1) closes the bottle 3 for transit; (2) communicates with the can 1 so as to receive the carbon dioxide therefrom under pressure when the can 1 has been actuated by the regulator 4 being in the position shown in FIG. 3 (as will be hereinafter described); and (3) puts the bottle 3 into communication with atmosphere (viz. for dispensing the beverage therefrom) through the dip tube 15 and a spout 18).

Figure 5:
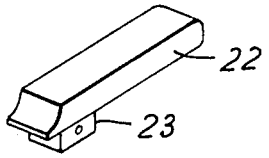
FIGS. 5 and 6 are perspective views of alternative flow control means.
Figure 6:
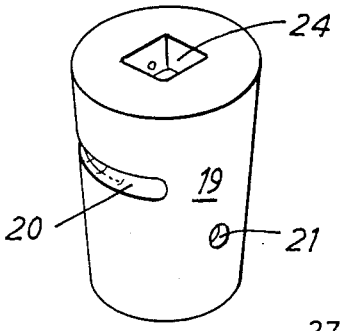
Figure 6:
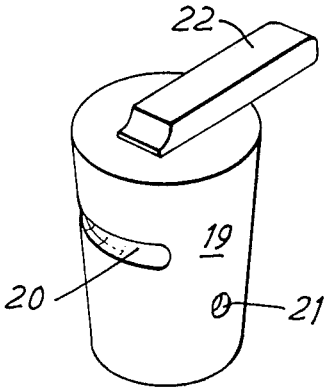
Figure 7:
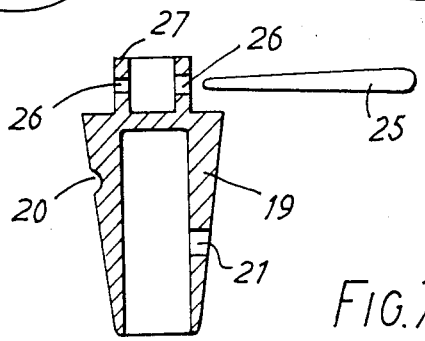
FIG. 7 is a sectional elevation of a modified form of the flow control means shown in FIGS. 5 and 6.

The tap 5 shown in FIG. 5 has a body portion provided with a tapered hole into which fits a similarly tapered plug 19 shown in cross-section in FIG. 4. The main working part of all the plugs 19 shown in FIGS. 5 to 7 is the same. It is partly hollow (as shown in FIG. 7) and provided with an arcuate surface channel 20 for the carbon dioxide and a hole 21 communicating with the beverage in the bottle 3 via the dip tube 15, and with the spout 18 via a hollow in the plug 19.

The plug 19 according to FIG. 5 has a handle 22 having a boss 23 of square cross-section is arranged to mate with a corresponding square-section recess 24 in the end of the plug 19, for manually rotating the plug for selective communication as described with reference to the tap shown in FIG. 4 (whose handle is not shown).

The plug 19 shown in FIG. 6 differs from that shown in FIG. 5 only in that the handle 22, instead of being detachable from the plug 19, is moulded integrally therewith.

The plug 19 shown in FIG. 7 has a "spike" handle 25 for insertion in transverse holes 26 in a boss 27 extending axially from the plug 19. It will also be noted that the channel 20 for the carbon dioxide is provided in a relatively thick region of the moulded plug 19 so as to have a relatively small effect on the rigidity of the latter, whilst the hole 21 for the beverage is provided in a thinner region of the tapered plug 19, this being tolerable because the quality of sealing for the liquid beverage is less critical than that for the pressurized carbon dioxide gas.

In use, the consumer opens a prepared panel (not shown) in the cardboard outer box 6. This reveals a further card panel (not shown), projecting through which is the tap 5 and a large diameter plastics button defined by the top of the housing 7.

Depressing this button locks open the aerosol valve 2 by resiliently snapping the skirt portion *7a* of the housing 7 over, so as to engage, the curl 9 on the cup 10 (see FIGS. 2 and 3).

Carbon dioxide passes at a so controlled pressure into the bottle 3 as required to maintain the required internal pressure. Opening of the tap 5 to dispense beverage reduces the pressure in the bottle 3 but the regulator 4 makes it up to the desired "keeping pressure".

The size of the can 1 and the characteristics of the diaphragm 13 are tailored to suit the particular carbonation requirements for specific beverages.

As indicated previously, the regulator 4 comprises a hollow housing 7 inside of which is fixed the diaphragm 13 supporting a needle valve 11. Also inside the housing 7 is a valve seat member defining a valve seat at 12.

As illustrated in FIG. 2, the housing comprises a flared side wall *7a* terminating at an open end in an inturned rim *7b* which permits snap fitting into the periphery at curl 9 of the valve cup 10. An end wall *7c* closes the top of the housing 7 and an outlet to 8 extends laterally from the sidewall *7a* above the diaphragm 13.

The diaphragm 13 is comprised of a flared annular portion 13*a*, the periphery of which is snap fitted into the housing wall 7a in a groove therein. A hollow cylindrical portion 13*b* of diaphragm 13 depends centrally from the annular portion 13*a* to terminate in an outwardly directed, fin-shaped flange 13*c*. A hollow cylindrical support 13*d* depends from within the cylindrical portion 13*b* to support the needle 11 defining an aperture for entry and passage of gas through the cylindrical portion 13*b*.

The valve seat member 12*a* comprises a flat annulus, the periphery of which is snap fitted into the groove in the housing side wall *7a* to seal the periphery of the diaphragm within the housing. There is a vent hole 12*b* penetrating the flat annulus. A cylindrical wall 12*c* extends from the inner edge of the flat annulus to an end wall 12*d* which defines the valve seat 12, and from which depends an entry pipe 12*e*.

The fin-shaped flange 13*c* of the diphragm 13 has a piston-like fit in the cylindrical wall 12*c* of the valve seat member. When the housing 7 is snap fitted into the aerosol valve cup the aerosol valve delivers gas under pressure through the clearance between the valve needle 11 and the seat as in the position illustrated in FIG. 2.

As gas passes the needle 11 into the hollow cylindrical poriton 13*d* of the diaphragm 13, a pressure develops above the diaphragm 13. It can be seen from FIGS. 2 and 3 that the annular area of the diaphragm presented to the just arrived gas is greater than the area of the needle presented to the seat, so that the force arising from the lower pressure acting on the larger area of the diaphragm, (restrained by the force required to flex the diaphragm) is able to balance or overcome the force arising from the pressure of gas in the can acting on the needle. Thus, a pressure regulating control function is automatically developed. It is, of course, necessary for the annular portion of the diaphragm to be free to flex so that it is desirable to provide the vent hole 12*b* through which air can pass for venting to permit the diaphragm to flex.

The main advantage of the apparatus embodying the invention is its construction which enables the apparatus to be produced cheaply enough for it to be disposable after use. Because the known apparatus uses a high-pressure bulb as a source of gas, the means for the attachment and bursting of the bulb and the associated regulator must use engineered parts of metal so that they are very expensive (about £15.00). In contrast, an apparatus according to the invention uses a low-pressure source of gas. It uses no bursting means and the regulator is, as shown, made of plastics mouldings which snap fit together during assembly, so that its cost is so low (about £0.05) that the whole apparatus is disposable. This brings about the advantage that the user need not fit the source of gas and clean the regulator. A further advantage is that the provision of a package which is safe in transit because the gas is in a can sealed by a valve and the bottle of liquid is firmly closed.

I claim:

1. Apparatus for storing and dispensing a quantity of aerated liquid for maintaining the carbonation of a beverage in a container in which the extent of aeration is maintained as said quantity is progressively dispensed, said apparatus comprising a vessel containing a source of gas; a valve closing said vessel; a pressure regulator coupling said valve to said container, said regulator being capable of delivering said gas to said container at a substantially constant pressure substantially lower than said pressure under which said gas is kept in said vessel; said regulator comprising a housing, a diaphragm, and means supporting the diaphragm in the housing, said diaphragm having a ratio of the area downstream thereof to the area upstream thereof so that the gas is caused to be delivered to said container at said constant pressure lower than said pressure under which said gas is kept in said vessel and flow control means which permit delivery of said gas to, and dispensing of said liquid from, said container, said vessel being an aerosol can having a closure cup and containing carbon dioxide, and said regulator having a skirt portion arranged for engagement with said closure cup, the arrangement being such that in a transit condition of the apparatus said valve is closed and in an operational condition of the apparatus said skirt portion is engaged with said cup and said pressure regulator engages said valve, thereby causing said valve to be open.

2. Apparatus according to claim 1 wherein said apparatus is contained within an enclosure which is adapted to permit dispensing of said liquid which is defined by a carbonated beverage.

3. Apparatus according to claim 1, wherein said flow control means are defined by a tap having a detachable handle.

4. Apparatus according to claim 1 wherein said pressure regulator housing has an outlet connected to said flow control means and an entrance, a hollow needle valve supported by said diaphragm, said housing having a housing member defining a valve seat, a guide tube extending axially to seal with the needle valve and extending to a radial flange joined to the housing, said flange having a vent hole therein to permit the diaphragm to flex under the influence of downstream pressure in the housing to force the needle valve toward the valve seat to moderate the pressure of gas supplied to the vessel.

5. Apparatus according to claim 1 wherein said housing and diaphragm are constructed of plastic members that are snap-fitted together.

6. Apparatus according to claim 1 wherein the vessel is a bottle injection blow molded from a plastic material such as polyethylene terephthalate.

7. Apparatus according to claim 1 including an enclosing cardboard box.

8. Apparatus for storing and dispensing a quantity of aerated liquid in which the extent of aeration is maintained as said quantity is progressively dispensed, said apparatus comprising a low-pressure source of gas in the form of a vessel; a valve closing said vessel; a container for said liquid, said container being connected to said vessel via a pressure regulator which is capable of delivering said gas to said container at a substantially constant pressure substantially lower than said pressure under which said gas is kept in said vessel; and flow control means which permit delivery of said gas to, and dispensing of said liquid from, said container, wherein said vessel is an aerosol can having a closure cup and containing carbon dioxide, and said regulator has a skirt portion arranged for engagement with said closure cup, the arrangement being such that in a transit condition of the apparatus said valve is closed and in an operational condition of said apparatus said skirt portion is engaged with said cup and said pressure regulator engages said valve, thereby causing said valve to be open.

* * * * *